US006055389A

United States Patent [19]

Takahashi

[11] Patent Number: 6,055,389

[45] Date of Patent: Apr. 25, 2000

[54] ELECTROPHOTOGRAPHIC PRINTER DETERMINING TRANSFER VOLTAGE FROM VOLTAGE READINGS

[75] Inventor: Zenji Takahashi, Tokyo, Japan

[73] Assignee: Oki Data Corporation, Tokyo, Japan

[21] Appl. No.: 09/192,135

[22] Filed: Nov. 13, 1998

[30] Foreign Application Priority Data

Nov. 28, 1997 [JP] Japan ..... 9-328266

[51] Int. Cl.[7] ..... G03G 15/14; G03G 15/00

[52] U.S. Cl. ..... 399/66; 399/9; 399/89; 399/313

[58] Field of Search ..... 399/66, 9, 88, 399/89, 313, 314, 168

[56] References Cited

U.S. PATENT DOCUMENTS 5,034,777 7/1991 Ohzeki et al. ..... 399/66
5,151,736 9/1992 Ohzeki et al. ..... 399/66
5,179,397 1/1993 Ohzeki et al. ..... 399/168
5,196,885 3/1993 Takeuchi et al. ..... 399/168
5,682,575 10/1997 Komori ..... 399/66

*Primary Examiner*—Richard Moses
*Attorney, Agent, or Firm*—Akin, Gump, Stauss, Hauer & Feld, L.L.P.

[57] ABSTRACT

The transfer voltage supplied to the transfer roller in an electrophotographic printer is determined by feeding current to the transfer roller and reading the voltage produced by passage of the current through the transfer roller. Whether the transfer roller is adequately charged is determined by comparing the voltage reading with a previous voltage reading. The voltage reading is preferably an average reading taken over one revolution of the transfer roller. Alternatively, separate voltage readings are taken for different radial sectors of the transfer roller, and the transfer voltage is determined separately for each radial sector.

10 Claims, 7 Drawing Sheets

ELECTROPHOTOGRAPHIC PRINTER DETERMINING TRANSFER VOLTAGE FROM VOLTAGE READINGS

BACKGROUND OF THE INVENTION

The present invention relates to an electrophotographic recording apparatus or printer, more particularly to a method of controlling the transfer voltage in an electrophotographic printer.

An electrophotographic printer transfers a toner image from a photosensitive drum to a recording medium such as paper by applying a voltage to a transfer roller as the recording medium passes between the transfer roller and the photosensitive drum. The applied voltage, referred to as the transfer voltage, creates an electric field in the space between the photosensitive drum and transfer roller. The electric field attracts toner particles from the photosensitive drum to the recording medium.

The optimum transfer voltage depends in part on the electrical resistance between the transfer roller shaft and the surface of the transfer roller. This resistance varies with ambient temperature and humidity conditions, and with aging changes in the transfer roller. The resistance may also vary when measured at different points on the roller surface, due to physical irregularities in the roller composition. In addition, the capacitance of the transfer roller needs to be fully charged before the transfer process begins, and the charging rate varies according to the roller resistance. For these reasons, printing defects may occur if the printer's control system simply supplies a fixed transfer voltage to the transfer roller for a fixed time.

U.S. Pat. No. 5,682,575 discloses a method of adjusting the transfer voltage according to resistance measurements made both before and after the recording medium enters the space between the photosensitive drum and transfer roller, but this method does not allow for variations in charging time, or variations in resistance as the roller rotates.

SUMMARY OF THE INVENTION

It is accordingly an object of the present invention to supply an optimum transfer voltage for transfer of a toner image in an electrophotographic printer.

Another object of the invention is to compensate for differences in the electrical resistance of different parts of the transfer roller.

A further object is to assure that the transfer roller is adequately charged before transfer of the toner image begins.

The invented electrophotographic printer has a transfer power source that feeds current to the transfer roller before each toner image is transferred, and supplies a transfer voltage to the transfer roller while the toner image is being transferred. A voltage reading module takes a voltage reading of the voltage generated by passage of the current through the transfer roller before the toner image is transferred, and stores the voltage reading in a memory. A voltage setting module sets the transfer voltage according to the voltage reading.

According to one aspect of the invention, the voltage reading module takes an average voltage reading over one complete revolution of the transfer roller.

According to another aspect of the invention, the voltage readings taken over two revolutions of the transfer roller are compared to determine whether the transfer roller is adequately charged.

According to still another aspect of the invention, the voltage reading module waits for a predetermined time, equal to at least one revolution of the transfer roller, before taking voltage readings.

According to yet another aspect of the invention, multiple voltage readings are taken and stored during each revolution, the readings corresponding to the electrical resistances of different radial sectors of the transfer roller. The transfer voltage is set separately for each radial sector.

DETAILED DESCRIPTION OF THE INVENTION

Figure 1:
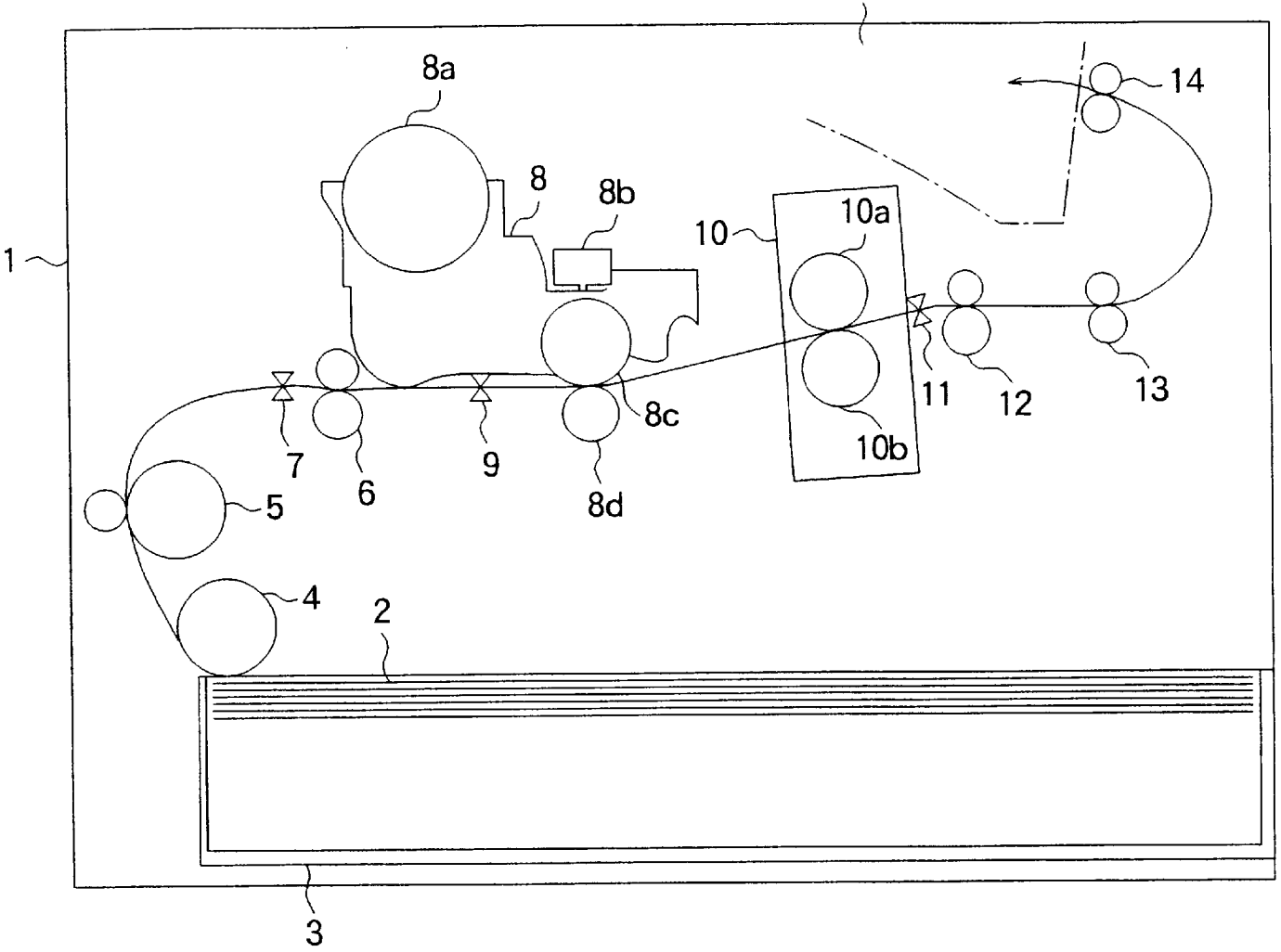
FIG. 1 PRIOR ART
FIG. 1 is a schematic sectional view of an electrophotographic printer.

Embodiments of the invention will be described with reference to the attached illustrative drawings, in which like parts are identified by like reference characters, following a general description of the relevant parts of an electrophotographic printer in which the invention is employed.

Referring to FIG. 1, this electrophotographic printer 1 has a supply of paper 2 stored in a cassette 3, and a hopping roller 4 that feeds the paper, one sheet at a time, to a first pair of transport rollers 5. The paper is transported from the first pair of transport rollers 5 to a second pair of transport rollers 6, passing a first sensor 7 en route. From the second pair of transport rollers 6, the paper passes under an image-forming unit 8 comprising a toner cartridge 8*a*, an optical printing head 8*b*, a photosensitive drum 8*c*, and a transfer roller 8*d*. A toner image is formed on the photosensitive drum 8*c* by the optical printing head 8*b* in response to dot data received from a host device (not visible). The toner image is transferred to the paper as the paper passes between the photosensitive drum 8*c* and transfer roller 8*d*. The position of the paper is sensed by a second sensor 9 disposed below the image-forming unit 8.

The paper next passes through a fusing unit 10 comprising a heat roller 10*a* and pressure roller 10*b*, which fuse the toner image onto the paper. Exit of the paper from the fusing unit 10 is detected by a third sensor 11. Further pairs of transport rollers 12, 13, 14 deliver the printed paper to a stacker 15 at the top of the printer.

Figure 2:
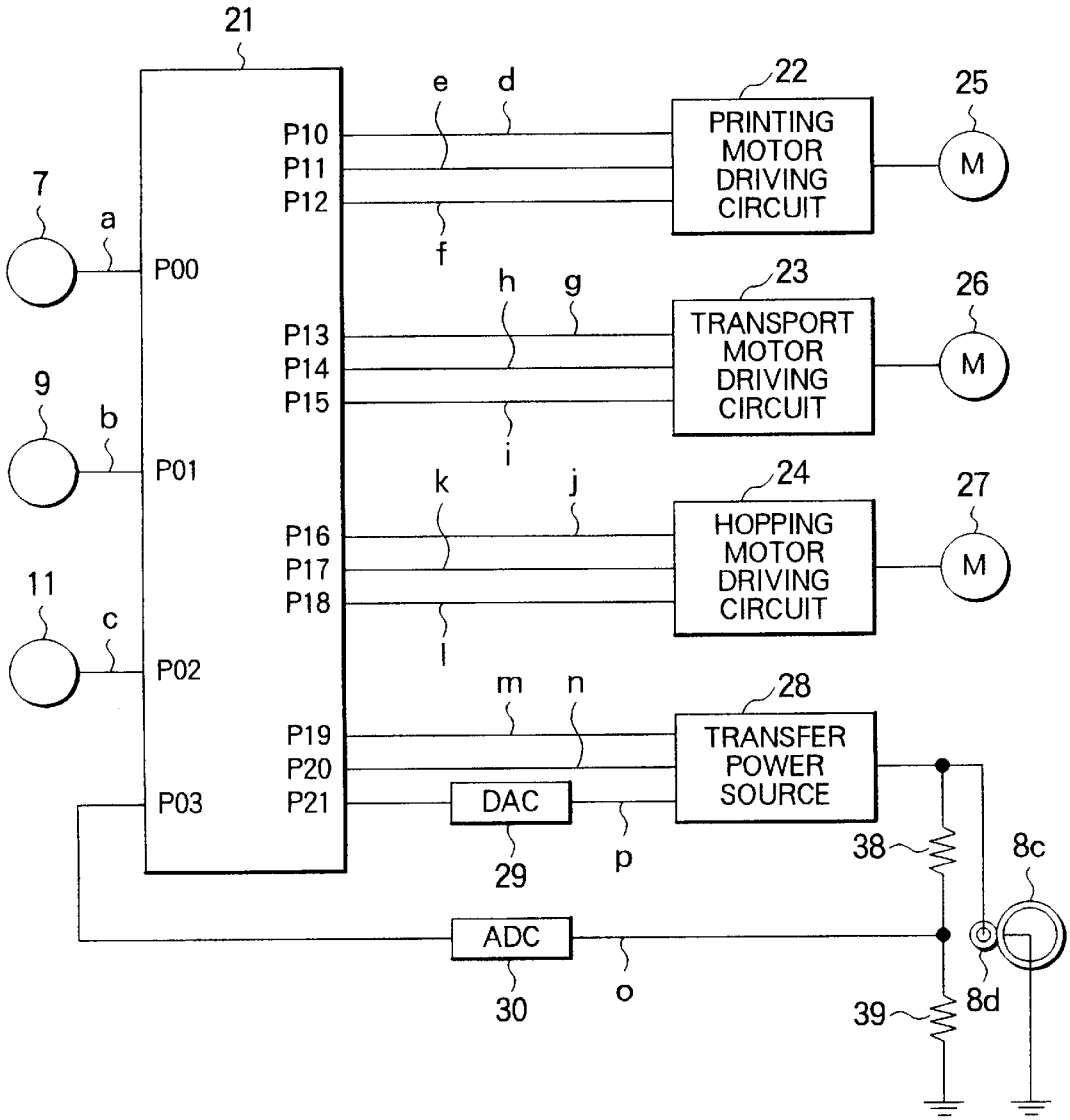
FIG. 2 is a block diagram of the control system of an electrophotographic printer illustrating first and second embodiments of the invention.

The first embodiment of the invention is an electrophotographic printer 1 as shown in FIG. 1, having the control system shown in FIG. 2. The printer is controlled by a microprocessor or microcontroller 21 having input ports P00, P01, P02 that receive signals (a, b, c) from the sensors 7, 9, 11; output ports P10, P11, P12 that send an enable signal (d) and phase signals (e, f) to a printing motor driving circuit 22; output ports P13, P14, P15 that send similar control signals (g, h, i) to a transport motor driving circuit 23; and output ports P16, P17, P18 that send similar control signals (j, k, 1) to a hopping motor driving circuit 24. The printing motor driving circuit 22 drives a motor 25 that turns the photosensitive drum 8*c* and transfer roller 8*d* in the image-forming unit 8, and the heat roller 10*a* in the fusing unit 10. The transport motor driving circuit 23 drives a motor 26 that turns transport rollers 6 and 12. The hopping motor driving circuit 24 drives a motor 27 that turns the hopping roller 4 and the first pair of transport rollers 5. Motors 25, 26, 27 are stepping motors that are driven by the switching of their phase signals (e, f, h, i, k, 1) when their enable signals (d, g, j) are active.

The microcontroller 21 also has output ports P19 and P20 that send control signals to a transfer power source 28 capable of both constant-current and constant-voltage output. The signal (m) from port P19 switches the transfer power source 28 on and off, thereby determining when power is supplied to the transfer roller 8*d*. The signal (n) from port P20 is a mode selection signal that selects constant-current output or constant-voltage output.

In addition, the microcontroller 21 has an output port P21 that sends a multiple-bit digital signal to a digital-to-analog converter (DAC) 29, and an input port P03 that receives a multiple-bit digital signal from an analog-to-digital converter (ADC) 30. The ADC 30 generates a digital signal, indicative of the output voltage of the transfer power source 28, from an analog voltage level (o) obtained by a pair of resistors 38 and 39 that divide the output voltage of the transfer power source 28. The DAC 29 converts the digital output from port P21 to an analog signal (p) that controls the current or voltage supplied by the transfer power source 28.

Figure 3:
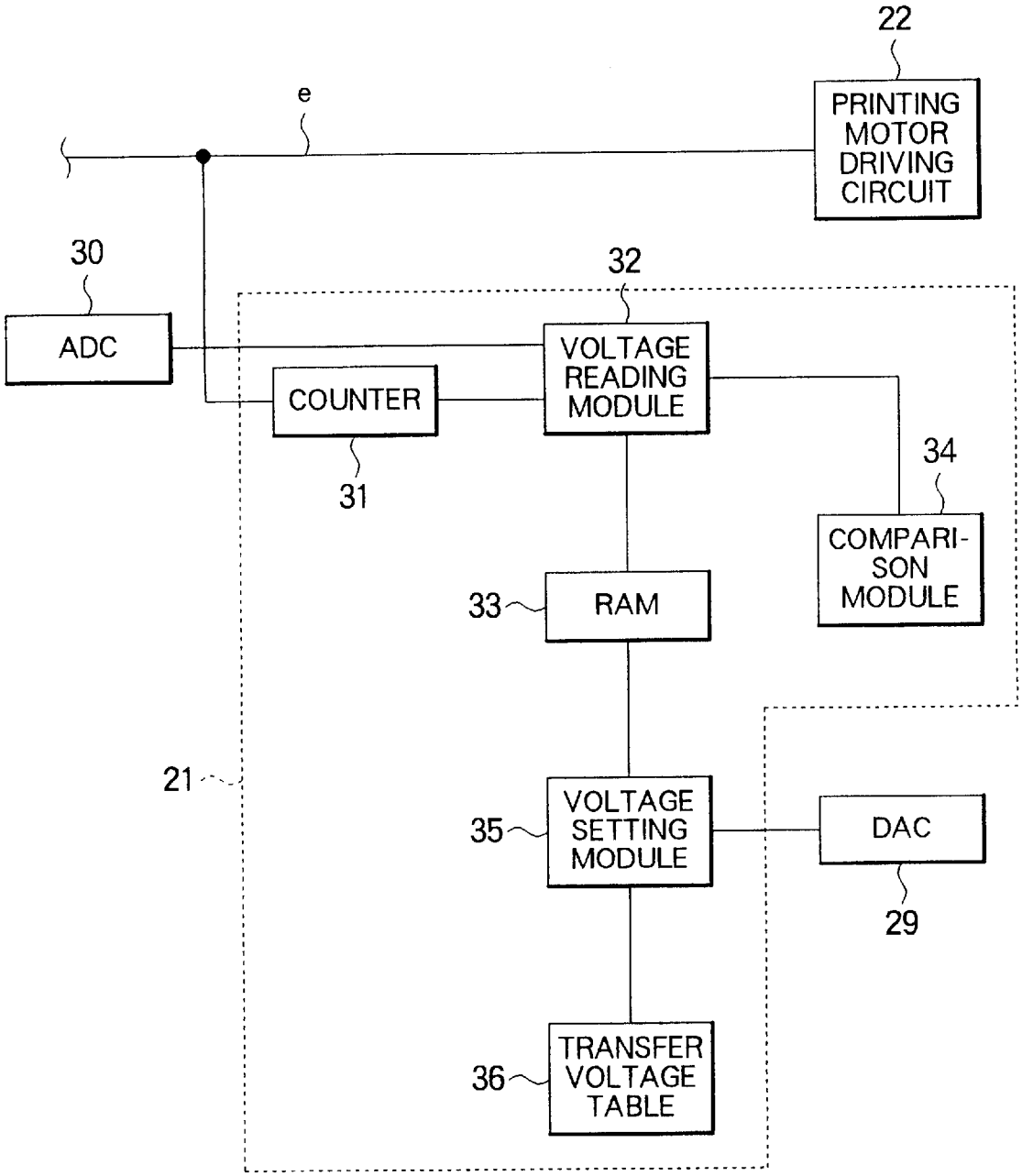
FIG. 3 is a more detailed block diagram showing parts of the control system in the first embodiment.

Referring to FIG. 3, one of the two phase signals sent from the microcontroller 21 to the printing motor driving circuit 22 (signal e) is also supplied to a counter 31. By counting pulses of this signal (e), the counter 31 tracks the rotation of the transfer roller 8*d*. At intervals of a fixed number of pulses, the counter 31 sends an output signal to a voltage reading module 32, causing the voltage reading module 32 to read the output of the ADC 30. The values read by the voltage reading module 32 will be referred to below as voltage readings.

The voltage reading module 32 computes the average of the voltage readings taken over an interval corresponding to one complete revolution of the transfer roller 8*d*, and stores the average voltage reading in a random-access memory (RAM) 33. Before being stored, each average voltage reading is compared with the previously stored average voltage reading by a comparison module 34, to determine whether the difference between the two average voltage readings exceeds a predetermined threshold.

The average voltage reading stored in the RAM 33 is also read by a voltage setting module 35, which consults a transfer voltage table 36 stored in a read-only memory (ROM), flash memory, or the like to obtain a digital value, and sets this digital value in the DAC 29 via port P21. The transfer voltage table 36 is a look-up table listing an appropriate number of values in the range of readings that can be taken from the ADC 30, and giving corresponding values to be set in the DAC 29.

The voltage reading module 32, comparison module 34, and voltage setting module 35 are, for example, software modules executed by the microcontroller 21, stored in the same memory as the transfer voltage table 36. This memory, the RAM 33, and the counter 31 are integrated into the microcontroller 21.

Figure 4:
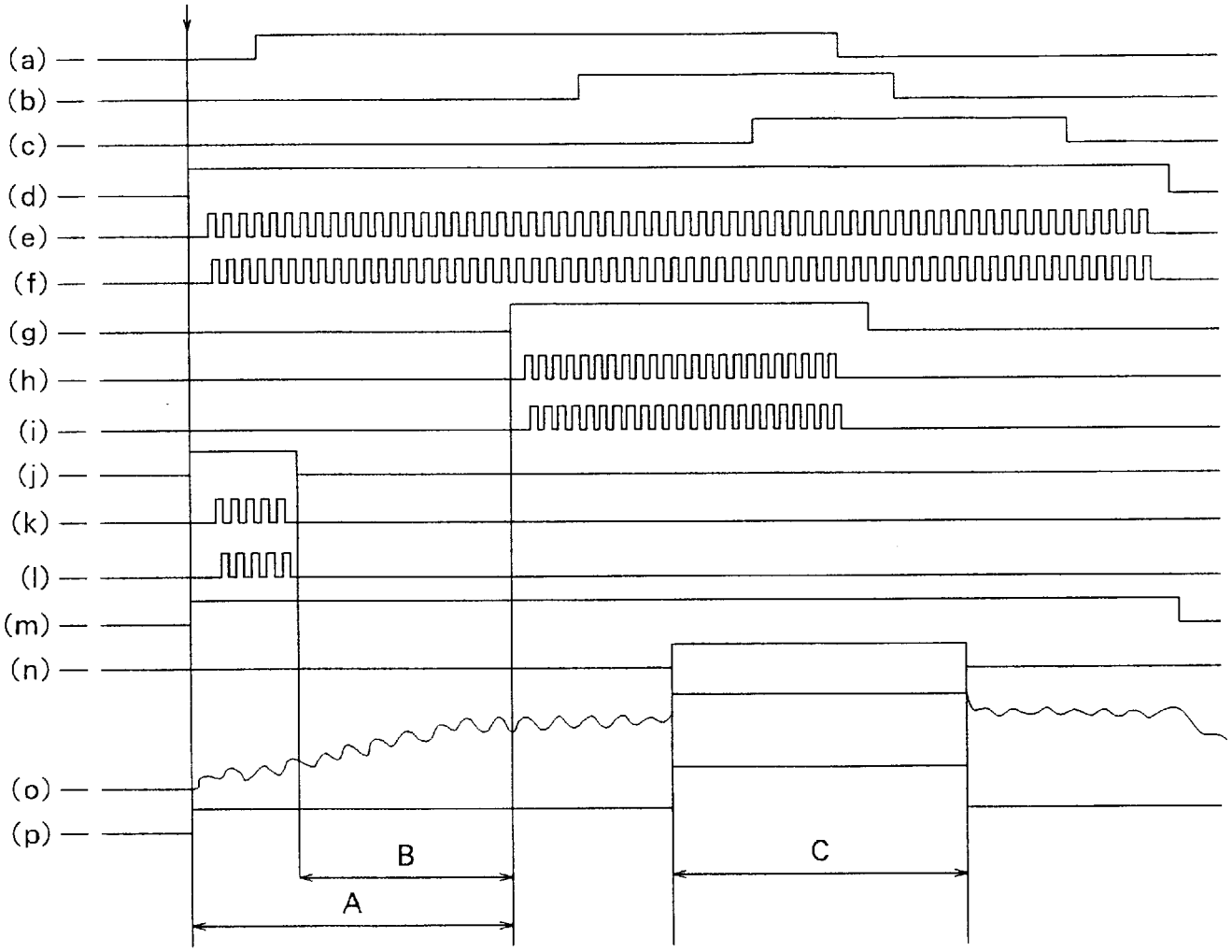
FIG. 4 is a timing diagram illustrating the operation of the first embodiment.

Next, the operation of the first embodiment in printing one page will be described, with reference to the timing diagram in FIG. 4.

Upon being commanded to print the page, the microcontroller 21 activates the signals (d, j, m) that turn on the printing motor driving circuit 22, hopping motor driving circuit 24, and transfer power source 28. The microcontroller 21 then begins output of phase pulses (e, f) that drive motor 25, turning the photosensitive drum 8*c*, transfer roller 8*d*, and heat roller 10*a*. At substantially the same time, the microcontroller 21 begins output of phase pulses (j, k) that drive motor 27, turning the hopping roller 4, thereby extracting a sheet of paper 2 from the cassette 3. The paper is fed through the first pair of transport rollers 5 toward the second pair of transport rollers 6.

The mode selection signal (n) is initially left low, selecting constant-current output. The voltage setting module 35 sends a predetermined initial value from port P21 to the DAC 29, which generates a corresponding analog signal (p) that determines the constant amount of current supplied by the transfer power source 28 to the transfer roller 8*d*. Output of the analog signal (p) at its initial level actually begins slightly before the transfer power source 28 is turned on by signal (m), although this is not visible in the drawing.

Current fed from the transfer power source 28 charges the transfer roller 8*d*, causing the ADC 30 to receive a generally increasing input voltage (o) and generate a generally increasing output signal. At intervals corresponding to a fixed number of phase pulses (e), as counted by the counter 31, the voltage reading module 32 reads the output of the ADC 30. The voltage reading module 32 maintains an internal cumulative total of the readings taken over one revolution of the transfer roller 8*d*. When the transfer roller 8*d* has completed one revolution, as determined from the phase pulse counts, the voltage reading module 32 computes an average voltage reading for the completed revolution, and stores this average voltage reading in the RAM 33.

During the second revolution of the transfer roller 8*d*, the voltage reading module 32 repeats the above procedure, and computes the average voltage reading taken during the second revolution. The comparison module 34 compares this new average voltage reading with the average voltage reading for the first revolution, which is stored in the RAM 33. The transfer roller 8*d* is considered to be adequately charged if the difference between the two average voltage readings is equal to or less than the above-mentioned threshold, and to be inadequately charged if the difference exceeds the threshold. In either case, the voltage reading module 32 stores the average voltage reading obtained from the second revolution in the RAM 33, replacing the average voltage reading obtained from the first revolution.

If the transfer roller 8*d* is inadequately charged, the same procedure is repeated during a third revolution, and if necessary during further revolutions, until the comparison module 34 finds that the difference between the average voltage readings in two consecutive revolutions does not exceed the threshold. The threshold is preferably small enough so that adequate charging of the transfer roller 8*d* is not recognized until substantially equal average voltage readings are obtained in two consecutive revolutions of the transfer roller. In FIG. 4, the voltage reading module 32 continues to take voltage readings throughout interval A.

In the meantime, the leading edge of the paper 2 has passed the first sensor 7, causing the sensor signal (a)

received at port P00 to go high. The paper is fed a certain distance past the point at which this signal (a) goes high, the distance being measured by the counting of phase pulses. The microcontroller 21 then halts output of signals (j, k, l) to the hopper motor driving circuit 24, stopping motor 27 at a position in which the leading edge of the paper is pushed against the second pair of transport rollers 6.

The paper 2 rests in this position until the comparison module 34 determines that the transfer roller 8*d* is adequately charged. In FIG. 4, the paper rests in this position during interval B. When the transfer roller 8*d* has been adequately charged, the microcontroller 21 begins output of signals (g, h, i) to the transport motor driving circuit 23, causing motor 26 to turn transport rollers 6, feeding the paper toward the transfer roller 8*d*. When the leading edge of the paper passes the second sensor 9, the sensor signal (b) received at port P01 goes high. By counting phase pulses, the microcontroller 21 determines when the leading edge of the paper reaches the point of contact between the photosensitive drum 8*c* and transfer roller 8*d*. At this point, the microcontroller 21 drives the mode selection signal (n) to the high level, selecting constant-voltage output.

At the same time, the voltage setting module 35 reads the transfer voltage table 36 to find the output value corresponding to the final average voltage reading stored in the RAM 33, and sets this output value in the DAC 29. The DAC output signal (p) changes to match the new output value, which is typically higher than the initial value. The transfer power source 28 now supplies the transfer roller 8*d* with a constant voltage, determined by the new output (p) of the DAC 29.

While held at a constant voltage by the transfer power source 28 during interval C, the transfer roller 8*d* continues to rotate, drawing the paper 2 through the space between the transfer roller 8*d* and photosensitive drum 8*c*. The electric field produced in this space by the transfer voltage attracts toner particles away from the photosensitive drum 8*c*, thus transferring a toner image to the paper.

When the trailing edge of the paper 2 passes the first sensor 7, the sensor input (a) to port P00 goes low. When the trailing edge of the paper has passed the first pair of transport rollers 6, the microcontroller 21 discontinues output of the signals (g, h, i) that drive motor 26.

When the trailing edge of the paper 2 passes the second sensor 9, the signal (b) received at port P01 goes low. By counting phase pulses (e) sent to motor 25 from this point, the microcontroller 21 determines when the trailing edge of the paper 2 leaves the transfer roller 8*d*. Since transfer of the toner image has been completed, the microcontroller 21 then returns the mode selection signal (n) to the low level, and the voltage setting module 35 resets the DAC 29 to the predetermined initial value. The transfer power source 28 thus reverts to feeding a constant current to the transfer roller 8*d*, to maintain the electrical charge in the transfer roller 8*d*. The voltage reading module 32 begins taking voltage readings from the ADC 30 again.

After leaving the transfer roller 8*d*, the paper 2 is transported through the fusing unit 10, which fuses the toner image, and delivered to the stacker 15. A measured time after the trailing edge of the paper passes the third sensor 11, causing the signal (c) received at port P02 to go low, the microcontroller 21 ceases output of signals (d, e, f) to the printing motor driving circuit 22, and turns off the transfer power source 28 by deactivating its control signal (m).

By waiting until substantially equal average voltage readings are obtained over two revolutions of the transfer roller 8*d*, the first embodiment assures that image transfer does not begin until the transfer roller has been adequately charged, even if the time required to reach the adequately charged state varies due to ambient conditions, aging changes, or other changes that affect the resistance and capacitance of the transfer roller.

During constant current output, once the electrical capacitance of the transfer roller 8*d* has been charged, the constant current flows from the shaft of the transfer roller through the resistance offered by the roller body to the photosensitive drum 8*c*, the interior of which is grounded as shown in FIG. 2. Thus the average voltage reading stored in the RAM 33 depends on the electrical resistance between the shaft and surface of the transfer roller 8*d*, and when the voltage setting module 35 sets the transfer voltage according to that average voltage reading, the voltage setting module 35 is actually adjusting the transfer voltage according to the resistance of the transfer roller 8*d*. The values in the transfer voltage table 36 are pre-calculated to produce successful transfer of the toner image at the resistance corresponding to the stored voltage reading.

After the page has been printed, the transfer power source 28 continues to feed constant current to the transfer roller 8*d*, and the microcontroller 21 continues to monitor the resulting voltage readings. When the printing of a first page is followed by a command to print a second page before the first page has been delivered to the stacker 15, the transfer roller 8*d* remains charged and ready to print the second page without delay.

In a variation of the first embodiment, instead of first comparing the average voltage readings obtained during the first two revolutions of the transfer roller 8*d*, the voltage setting module 35 first compares the average voltage reading during the first revolution with the last average voltage reading obtained when the previous page was printed. This variation is particularly advantageous during the continuous printing of pages.

In another variation, the voltage reading module 32 takes only one voltage reading per revolution, instead of talking multiple voltage readings and calculating an average value. The first voltage reading is taken at the end of the first revolution, for example. This variation simplifies the processing done by the voltage reading module 32.

In still another variation, the microcontroller 21 assumes that the transfer roller 8*d* has been adequately charged after a constant current has been output from the transfer power source 28 for a fixed time, as measured by a timer. The voltage reading module 32 takes a single voltage reading just before the end of the fixed time, and stores the reading in the RAM 33. The voltage setting module 35 sets the transfer voltage according to this single voltage reading. The fixed time should be equivalent to at least one complete revolution of the transfer roller 8*d*.

Next, a second embodiment will be described. The second embodiment differs from the first embodiment in that the transfer voltage is varied during the transfer process.

Figure 5:
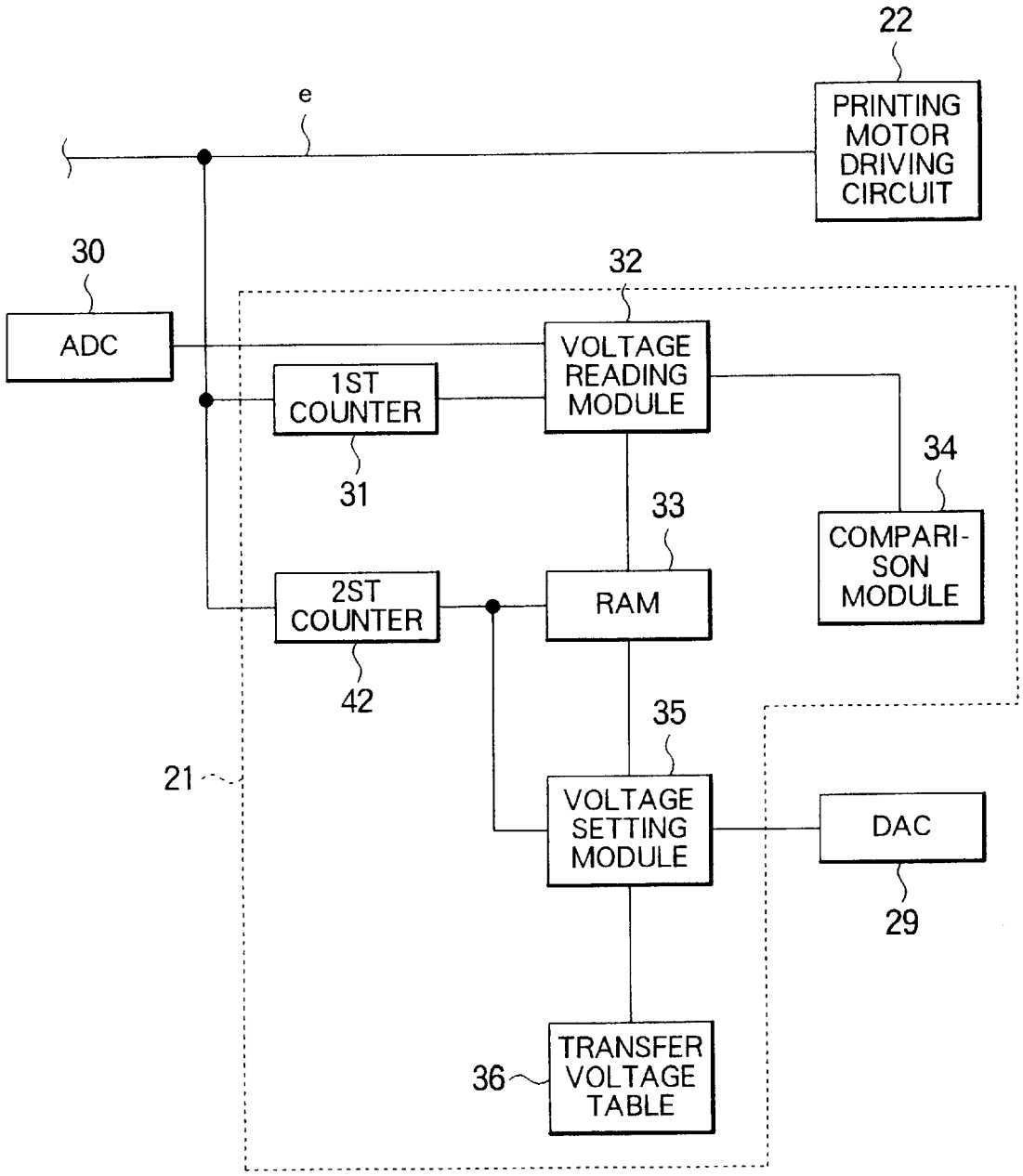
FIG. 5 is a more detailed block diagram showing parts of the control system in the second embodiment.

Referring to FIG. 5, the microcontroller 21 in the second embodiment has a second counter 42, in addition to the elements described in the first embodiment. Counter 31 will now be referred to as the first counter. Like the first counter 31, the second counter 42 counts phase pulses (signal e) supplied to the printing motor driving circuit 22. At fixed intervals, the second counter 42 sends signals to the RAM 33 and voltage setting module 35.

Figure 6:
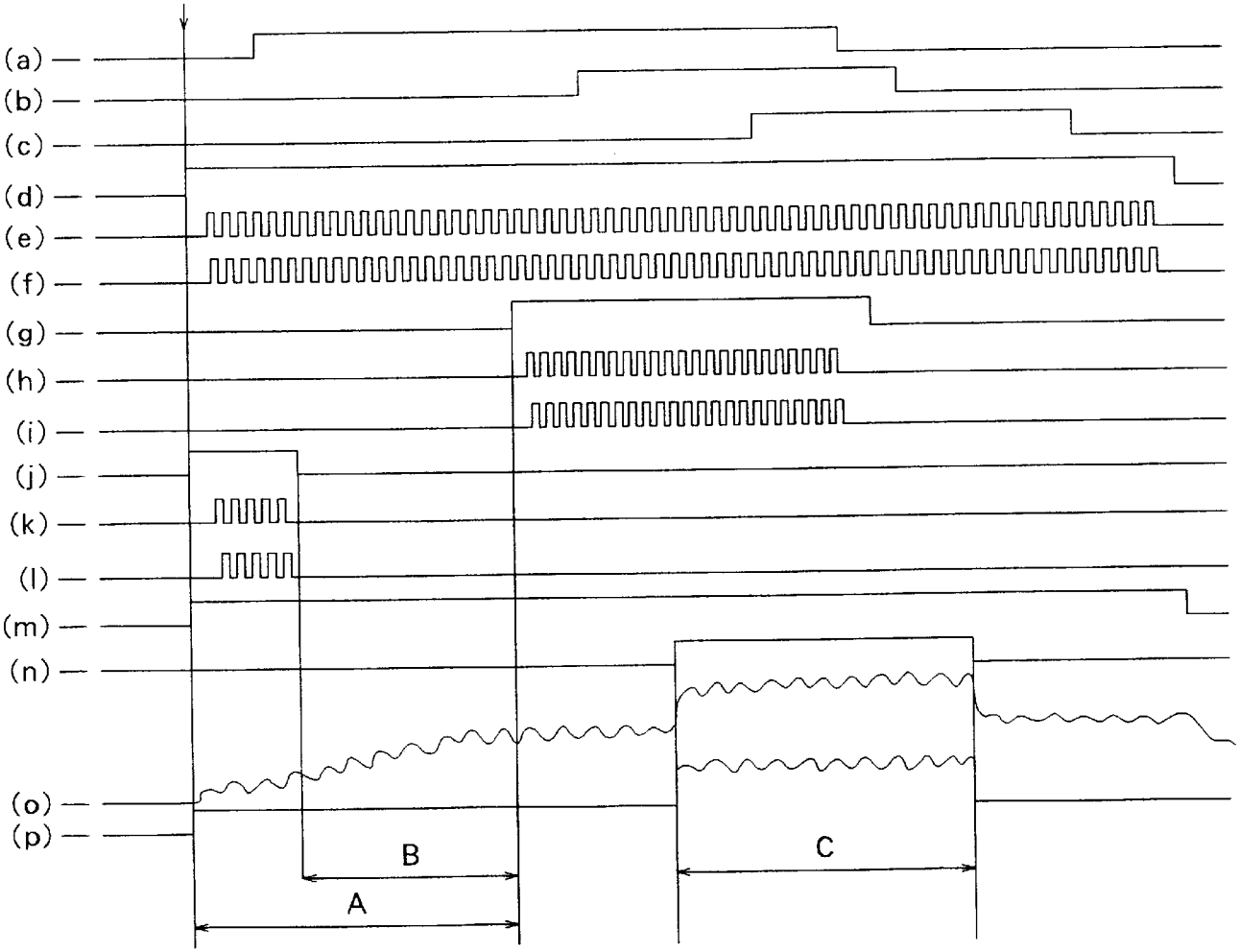
FIG. 6 is a timing diagram illustrating the operation of the second embodiment.

Referring to FIG. 6, in regard to the control of motors 25, 26, and 27 (signals d to l), the second embodiment operates in the same way as the first embodiment. At the start of the first revolution of the transfer roller 8*d*, the voltage setting module 35 sets a predetermined initial value in the DAC 29, and the transfer power source 28 begins output of a corresponding constant current. During the first revolution of the transfer roller 8*d*, the voltage reading module 32 takes N+voltage readings, where N is a fixed positive integer. The individual voltage readings are stored in the RAM 33 at addresses X, X+1, +2 . . . , X+N, when X is a fixed base address. These addresses are generated by the second counter 42, which counts up from zero to N, incrementing once in each interval of the length counted by the first counter 31, then returns to zero and starts counting up again.

Figure 7:
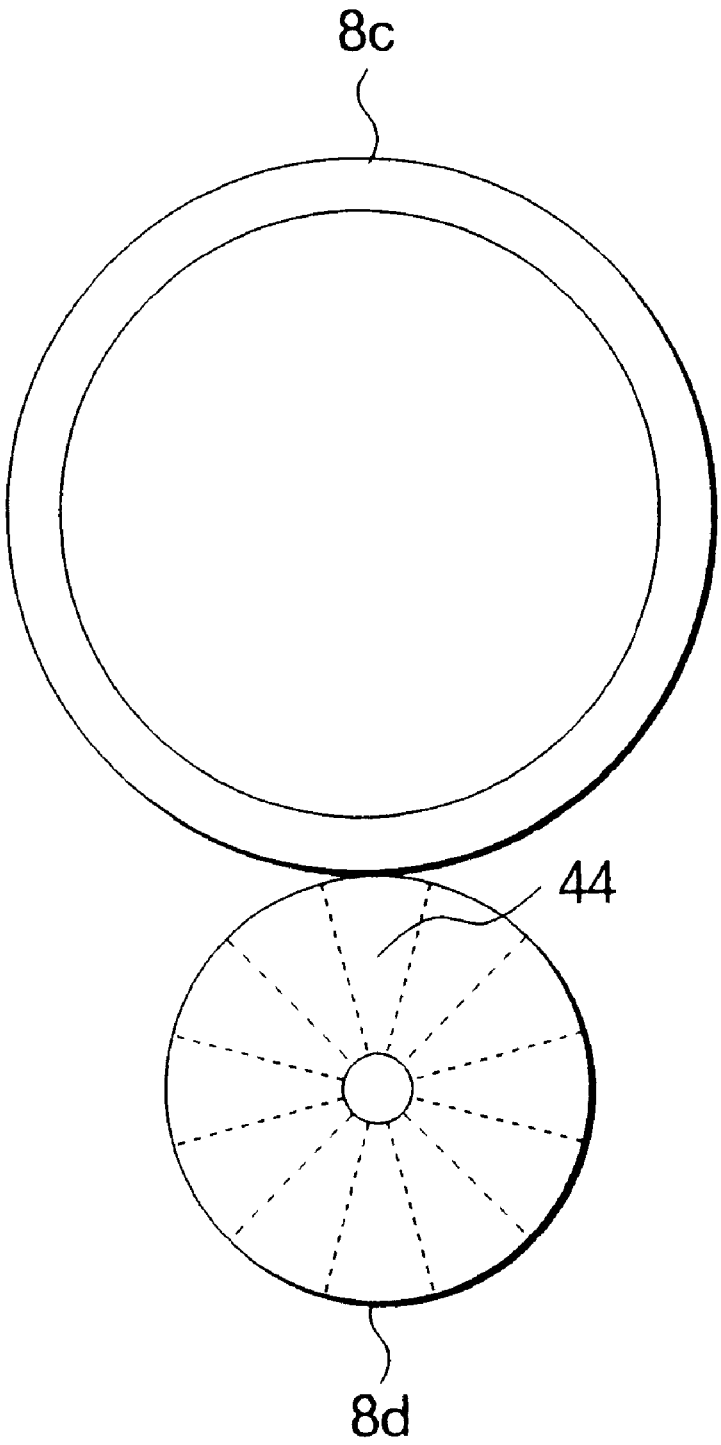
FIG. 7 is a sectional view of the transfer roller and photosensitive drum, showing radial sectors of the transfer roller.

Each counting cycle from zero to N corresponds to one complete revolution of the transfer roller 8*d*. The addresses thus correspond to N+1 radial sectors of the transfer roller 8*d*. FIG. 7 illustrates the case in which the transfer roller 8*d* is divided into twelve radial sectors 44 (N=11 as indicated by the dotted lines. The voltage reading taken by the voltage reading module 32 corresponds to the electrical resistance of the radial sector 44 touching the photosensitive drum 8*c*.

During the second revolution of the transfer roller 8*d*, the counters 31 and 42 and voltage reading module 32 perform the same operations as during the first revolution. In addition, the comparison module 34 compares each new voltage reading with the corresponding reading from the first revolution, representing the same radial sector of the transfer roller 8*d*. For example, the first voltage reading in the second revolution is compared with the first voltage reading in the first revolution, which is stored at address X in the RAM 33, and is then written into the RAM 33 at address X, replacing the first voltage reading in the first revolution.

When the difference between the two voltage readings compared by the voltage setting module 35 exceeds a certain threshold, the corresponding radial sector 44 of the transfer roller 8*d* is considered to be inadequately charged. The threshold is preferably small enough that a radial sector is considered to be adequately charged only when it gives substantially equal voltage readings in two consecutive revolutions.

If any radial sector 44 is found to be inadequately charged, the same operations are repeated during a third revolution of the transfer roller 8*d*, and if necessary during further revolutions, until all radial sectors of the transfer roller 8*d* are found to be adequately charged. When all of the radial sectors have been adequately charged, the voltage readings stored in the RAM 33 at addresses X, X+X+2 . . . , X+correspond to the electrical resistance of the N+1 radial sector When all radial sectors 44 have been adequately charged, at the end of intervals A and B in FIG. 6, the microcontroller 21 begins output of signals (g, h, i) to the transport motor driving circuit 23 as described in the first embodiment. When the leading edge of the paper reaches the transfer roller 8*d*, the microcontroller 21 drives the mode selection signal (n) to the high level, switching the transfer power source 28 from constant-current output to constant-voltage output, and the voltage setting module 35 begins to receive signals from the second counter 42, which is still tracking the rotation of the transfer roller 8*d* by counting cyclically from zero to N. During interval C, each time the second counter 42 increments, the voltage setting module 35 reads the value stored in the RAM 33 at the address indicated by the second counter 42, looks up the corresponding output value in the transfer voltage table 36, and sets this output value in the DAC 29. The analog signal (p) output by the DAC 29, hence the voltage output by the transfer power source 28, is thereby adjusted according to the individual resistance of each radial sector 44 of the transfer roller 8*d*.

When the trailing edge of the paper 2 leaves the transfer roller 8*d*, the microcontroller 21 returns the mode selection signal (n) to the low level, and the transfer power source 28 returns to constant current output at the predetermined initial level, as in the first embodiment, thus maintaining the transfer roller 8*d* in a charged state until the printing motor driving circuit 22 is switched off.

By taking a separate voltage reading for each radial sector of the transfer roller 8*d* and adjusting the transfer voltage from sector to sector according to these voltage readings, the second embodiment compensates for sector-to-sector variations in the electrical resistance of the transfer roller, and the toner image is transferred without defects, despite the existence of such variations.

In a variation of the second embodiment, during the first revolution of the transfer roller 8*d*, the comparison module 34 compares the voltage reading of each radial sector 44 with the voltage reading for the same sector stored in the RAM 33 for the previous page.

In another variation, the microcontroller 21 regards the transfer roller 8*d* as being fully charged after the transfer power source 28 has output constant current for a predetermined time, equivalent to at least one revolution of the transfer roller.

The DAC 29 and ADC 30 have been shown as separate from the microcontroller 21, but either the DAC or the ADC, or both, can be integrated into the microcontroller.

Those skilled in the art will recognize that further variations are possible within the scope claimed below.

What is claimed is:

1. An electrophotographic recording apparatus transferring toner images to a recording medium by applying a transfer voltage to a transfer roller, comprising:

a transfer power source supplying current to said transfer roller before each toner image among said toner images is transferred, and applying said transfer voltage to said transfer roller while said toner image is being transferred;

a voltage reading module coupled to said transfer power source, taking at least one voltage reading of a voltage generated by passage of said current through said transfer roller before each said toner image is transferred;

a memory coupled to said voltage reading module, storing said voltage reading;

a voltage setting module coupled to said memory, setting said transfer voltage according to said voltage reading, when each said toner image is transferred; and a comparison module comparing the voltage reading taken by said voltage reading module with a previous voltage reading stored in said memory, thereby determining when said transfer roller is adequately charged for transfer of said toner image to begin.

2. The electrophotographic recording apparatus of claim 1, wherein said comparison module determines that said transfer roller is adequately charged when the voltage reading taken by said voltage reading module differs from said previous voltage reading by an amount equal to or less than a predetermined value.

3. An electrophotographic recording apparatus transferring toner images to a recording medium by applying a transfer voltage to a transfer roller, comprising:

a transfer power source supplying current to said transfer roller before each toner image among said toner images is transferred, and applying said transfer voltage to said transfer roller while said toner image is being transferred;

a voltage reading module coupled to said transfer power source, taking at least one voltage reading of a voltage generated by passage of said current through said transfer roller before each said toner image is transferred;

a memory coupled to said voltage reading module, storing said voltage reading; and a voltage setting module coupled to said memory, setting said transfer voltage according to said voltage reading when each said toner image is transferred, wherein:

said voltage reading module takes multiple voltage readings during each complete revolution of said transfer roller, and stores said multiple voltage readings in said memory, said multiple voltage readings corresponding to different radial sectors of said transfer roller; and said voltage setting module sets different transfer voltages for said different radial sectors of said transfer roller.

4. The electrophotographic recording apparatus of claim 3, further comprising a comparison module comparing each voltage reading taken by said voltage reading module with a previous voltage reading stored in said memory, corresponding to a same one of said radial sectors, thereby determining when said transfer roller is adequately charged for transfer of said toner image to begin.

5. An electrophotographic recording apparatus transferring toner images to a recording medium by applying a transfer voltage to a transfer roller, comprising;

a transfer power source supplying a constant current to said transfer roller before each toner image among said toner images is transferred, and applying said transfer voltage to said transfer roller while said toner image is being transferred;

a voltage reading module coupled to said transfer power source, taking at least one voltage reading of a voltage generated by passage of said constant current through said transfer roller after said transfer power source has supplied said constant current to said transfer roller for a predetermined time equal to at least one complete revolution of said transfer roller and before each said toner image is transferred;

a memory coupled to said voltage reading module, storing said voltage reading; and a voltage setting module coupled to said memory, setting said transfer voltage according to said voltage reading, when each said toner image is transferred.

6. A method of controlling a transfer voltage applied to a transfer roller to transfer a toner image to a recording medium in an electrophotographic recording apparatus, comprising the steps of:

(a) supplying a constant current to said transfer roller before transferring said toner image;

(b) taking a voltage reading of a voltage produced by passage of said constant current through said transfer roller before transferring said toner image; and (c) setting the transfer voltage used to transfer said toner image according to said voltage reading;

(d) comparing said voltage reading with a previous voltage reading; and (e) if said voltage reading differs from said previous voltage reading by more than a predetermined threshold, repeating said steps (b) and (d) until two consecutive voltage readings that differ by an amount not exceeding said predetermined threshold are obtained, said transfer voltage being set according to the voltage reading obtained last.

7. The method of claim 6, wherein said steps (b) and (d) are repeated until two consecutive and substantially equal voltage readings are obtained.

8. A method of controlling a transfer voltage applied to a transfer roller to transfer a toner image to a recording medium in an electrophotographic recording apparatus, comprising the steps of:

(a) supplying a constant current to said transfer roller before transferring said toner image;

(b) taking a voltage reading of a voltage produced by passage of said, constant current through said transfer roller before transferring said toner image;

(c) setting the transfer voltage used to transfer said toner image according to said voltage reading;

(f) repeating said step (a) multiple times during one complete revolution of said transfer roller, thus obtaining multiple voltage readings corresponding to different radial sectors of said transfer roller;

(g) storing said multiple voltage readings in a memory; and (h) repeating said step (c) multiple times during each revolution of said transfer roller while said toner image is being transferred, setting said transfer voltage separately for each of said radial sectors of said transfer roller.

9. The method of claim 8, further comprising the steps of:

(i) comparing each of said multiple voltage readings with a previous voltage reading obtained for a same one of said radial sectors; and (j) if any one of said voltage readings differs from the previous voltage reading by more than a predetermined threshold, repeating said steps (f), (g), and (i), the transfer voltage for each radial sector in said step (h) being set according to the voltage reading obtained last for said radial sector.

10. A method of controlling a transfer voltage applied to a transfer roller to transfer a toner image to a recording medium in an electrophotographic recording apparatus, comprising the steps of:

(a) supplying a constant current to said transfer roller before transferring said toner image;

(b) taking a voltage reading of a voltage produced by passage of said constant current through said transfer roller, after said constant current has been supplied to said transfer roller for a predetermined time equal to at least one complete revolution of said transfer roller and before said toner image is transferred; and (c) setting the transfer voltage used to transfer said toner image according to said voltage reading.

* * * * *